US008558766B2

(12) United States Patent
Kwon

(10) Patent No.: US 8,558,766 B2
(45) **Date of Patent: *Oct. 15, 2013**

(54) ORGANIC LIGHT EMITTING DISPLAY AND METHOD OF DRIVING THE SAME

(75) Inventor: Oh-Kyong Kwon, Suwon (KR)

(73) Assignee: Samsung Display Co., Ltd., Yongin-si (KR)

( * ) Notice: Subject to any disclaimer, the term of this patent is extended or adjusted under 35 U.S.C. 154(b) by 1300 days.

This patent is subject to a terminal disclaimer.

(21) Appl. No.: 12/107,167

(22) Filed: Apr. 22, 2008

(65) Prior Publication Data

US 2009/0027423 A1 Jan. 29, 2009

(30) Foreign Application Priority Data

Jul. 27, 2007 (KR) ..... 10-2007-0075429

(51) Int. Cl.
*G09G 3/30* (2006.01)

(52) U.S. Cl.
USPC ..... 345/77; 345/204; 345/82; 345/690; 345/214; 315/169.3

(58) Field of Classification Search
USPC ..... 345/30, 76–77, 83, 211–212, 214–215, 345/690, 697; 315/169.3
See application file for complete search history.

(56) References Cited

U.S. PATENT DOCUMENTS 6,806,497 B2 * 10/2004 Jo ..... 257/59
7,944,418 B2 5/2011 Chung et al.
2002/0180369 A1 * 12/2002 Koyama ..... 315/169.1
2006/0038758 A1 * 2/2006 Routley et al. ..... 345/81
2009/0027423 A1 1/2009 Kwon

FOREIGN PATENT DOCUMENTS

| | | |
|---|---|---|
| JP | 2005-128272 | 5/2005 |
| JP | 2005-258427 | 9/2005 |
| JP | 2005-309230 | 11/2005 |
| JP | 2006-343763 | 12/2006 |
| KR | 2002-0046756 | 6/2002 |
| KR | 1020060029062 A | 4/2006 |
| KR | 10-2006-0054425 | 5/2006 |
| KR | 10-2006-0075772 | 7/2006 |
| KR | 10-2007-0015822 | 2/2007 |

OTHER PUBLICATIONS

Patent Abstracts of Japan, Publication No. 2006-343763; Date of Publication: Dec. 21, 2006; in the name of Shunpei Yamazaki et al.

(Continued)

*Primary Examiner* — Lun-Yi Lao
*Assistant Examiner* — Shaheda Abdin
(74) *Attorney, Agent, or Firm* — Christie, Parker & Hale, LLP

(57) ABSTRACT

An organic light emitting display and a method for driving the same, which may compensate for the degradation of an organic light emitting diode. The organic light emitting display includes: a plurality of pixels, each including an organic light emitting diode and a pixel circuit for controlling a supply of an electric current to the organic light emitting diode; and a sensing unit for converting a voltage applied to the organic light emitting diode to a digital value during a sensing period, and for sinking a second current from the pixel corresponding to the digital value to compensate for a degradation of the organic light emitting diode during a sampling period.

25 Claims, 10 Drawing Sheets

(56) References Cited

OTHER PUBLICATIONS

Korean Patent Abstracts, Publication No. 1020060054425 A; Date of Publication: May 22, 2006; in the name of Tomoyuki Maeda.
Korean Patent Abstracts, Publication No. 1020060075772 A; Date of Publication: Jul. 4, 2006; in the name of Do Wan Kim.
Korean Patent Abstracts, Publication No. 1020020046756 A; Date of Publication: Jun. 21, 2002; in the name of Seong Jun Bae, et al.
Korean Patent Abstracts, Publication No. 1020070015822 A; Date of Publication: Feb. 6, 2007; in the name of Do Hyung Ryu et al.
KIPO Notice of Allowance dated Feb. 27, 2009 for priority Korean application 10-2007-0075429, noting references listed in this IDS.
KIPO Office action dated Feb. 27, 2009, for Korean Patent application 10-2007-0075430, (2 pages).
U.S. Notice of Allowance dated Jan. 20, 2012, for cross reference U.S. Appl. No. 12/115,712 (Now U.S. Patent 8,174,518), (11 pages).

* cited by examiner

ORGANIC LIGHT EMITTING DISPLAY AND METHOD OF DRIVING THE SAME

CROSS-REFERENCE TO RELATED APPLICATION

This application claims priority to and the benefit of Korean Patent Application No. 10-2007-0075429, filed on Jul. 27, 2007, in the Korean Intellectual Property Office, the entire content of which is incorporated herein by reference.

BACKGROUND

1. Field of the Invention

The present invention relates to an organic light emitting display and a method of driving the same, and more particularly to an organic light emitting display and a method of driving the same, which compensates for the degradation of organic light emitting diodes.

2. Description of the Related Art

Recently, various flat plate displays capable of reducing weight and volume that are disadvantages of cathode ray tubes (CRTs) have been developed. Flat panel displays include liquid crystal displays (LCDs), field emission displays (FEDs), plasma display panels (PDPs), and organic light emitting displays.

Among the flat panel displays, the organic light emitting displays make use of organic light emitting diodes that emit light by re-combination of electrons and holes. The organic light emitting display has advantages of high response speed and small power consumption.

FIG. 1 is a circuit diagram showing a pixel of a conventional organic light emitting display.

With reference to FIG. 1, a pixel 4 of a conventional organic light emitting display includes an organic light emitting diode OLED and a pixel circuit 2. The pixel circuit 2 is coupled to a data line Dm and a scan line Sn, and controls the light emission of organic light emitting diode OLED.

An anode electrode of the organic light emitting diode OLED is coupled to a pixel circuit 2, and a cathode electrode of the organic light emitting diode OLED is coupled to a second power source ELVSS. The organic light emitting diode OLED generates light of a luminance corresponding to an electric current from the pixel circuit 2.

When a scan signal is supplied to the scan line Sn, the pixel circuit 2 controls an amount of electric current provided to the organic light emitting diode OLED corresponding to a data signal provided to the data line Dm. To do this, the pixel circuit 2 includes a second transistor M2, a first transistor M1, and a storage capacitor C. The second transistor M2 is coupled between a first power source ELVDD and the organic light emitting diode OLED. The first transistor M1 is coupled between the data line Dm and the scan line Sn. The storage capacitor C is coupled between a gate electrode and a first electrode of the second transistor M2.

A gate electrode of the first transistor M1 is coupled to the scan line Sn, and a first electrode of the first transistor M1 is coupled to the data line Dm. A second electrode of the first transistor M1 is coupled to one terminal of the storage capacitor C. Here, the first electrode of the first transistor M1 is one of a source electrode or a drain electrode, and the second electrode is the other one of the source electrode or the drain electrode. For example, when the first electrode is the source electrode, the second electrode is the drain electrode. When a scan signal from the scan line Sn is supplied to the first transistor M1 coupled to the scan line Sn and the data line Dm, the first transistor M1 is turned on and provides a data signal from the data line Dm to the storage capacitor C. At this time, the storage capacitor C is charged with a voltage corresponding to the data signal.

A gate electrode of the second transistor M2 is coupled to one terminal of the storage capacitor C, and a first electrode of the second transistor M2 is coupled to another terminal of the storage capacitor C and a first power source ELVDD. Further, a second electrode of the second transistor M2 is coupled to an anode electrode of the organic light emitting diode OLED. The second transistor M2 controls an amount of electric current flowing from the first power source ELVDD to a second power source ELVSS through the organic light emitting diode OLED according to the voltage charged in the storage capacitor C. At this time, the organic light emitting diode OLED emits light with a luminance corresponding to the amount of electric current supplied from the second transistor M2.

The pixel 4 of the conventional organic light emitting display displays images of desired luminance by repeating the aforementioned procedure. On the other hand, during a digital drive in which the second transistor M2 functions as a switch, a voltage of the first power source ELVDD and a voltage of the second power source ELVSS are supplied to the organic light emitting diode OLED. Accordingly, the organic light emitting diode OLED emits light with a voltage regulation drive (or regulated voltage drive). In the digital drive method, gradations of luminance (e.g., gray levels) are expressed using an emission time of the organic light emitting diode OLED while supplying a constant current to the organic light emitting diode OLED. However, in the digital drive method, because the organic light emitting diode OLED emits light with a voltage regulation drive (or regulated voltage drive), a degradation of the organic light emitting diode OLED progresses faster, with the eventual result that images of desired luminance cannot be displayed.

When the organic light emitting diode OLED degrades, resistance of the organic light emitting diode OLED increases. Accordingly, an electric current flowing to the organic light emitting diode OLED is reduced corresponding to the same voltage. This causes the luminance of images to be reduced.

SUMMARY OF THE INVENTION

Accordingly, it is an aspect of an exemplary embodiment of the present invention to provide an organic light emitting display and a method for driving the same, which compensates for the degradation of organic light emitting diodes.

The foregoing and/or other aspects of exemplary embodiments according to the present invention are achieved by providing an organic light emitting display including: a plurality of pixels, each pixel including an organic light emitting diode and a pixel circuit for controlling a supply of an electric current to the organic light emitting diode; and a sensing unit for supplying a first current to the organic light emitting diode in each of the pixels and converting a voltage applied to the organic light emitting diode to a respective one of digital values during a sensing period, and for sinking a second current from each of the pixels corresponding to the respective one of the digital values to compensate for a degradation of the organic light emitting diode during a sampling period.

The sensing unit may include: a current source unit for supplying the first current; a current digital-analog converter for sinking the second current; a switching unit for selectively coupling the current source unit and the current digital-analog converter to a feedback line among a plurality of feedback lines, wherein each of the feedback lines is coupled to at least one pixel among the plurality of pixels; an analog-digital converter coupled to the current source unit for converting a voltage applied to the organic light emitting diode to the respective one of the digital values; a memory for storing the digital values; and a controller for controlling a current amount of the second current sunk by the current digital-analog converter corresponding to the respective one of the digital values stored in the memory. The sensing unit may further include a plurality of channels, each channel coupled to a respective one of the feedback lines, and each channel including the current source unit, the switching unit, and the current digital-analog converter. The switching unit may include: a first switch between the feedback line and the current source unit; and a second switch between the feedback line and the current digital-analog converter. The first switch may be turned on during the sensing period, and the second switch may be turned on during the sampling period.

The current digital-analog converter may include: a current generator for generating a third current and a fourth current, the third current and the fourth current each in accordance with a current to flow to the organic light emitting diode before the organic light emitting diode is degraded; a first sink unit for sinking a fifth current from the feedback line corresponding to the third current supplied by the current generator; and a second sink unit for sinking a sixth current corresponding to the degradation of the organic light emitting diode from the feedback line corresponding to the fourth current supplied by the current generator.

The first sink unit may include: at least one first transistor being diode-connected for receiving the third current; and at least one second transistor coupled to the at least one first transistor as a current mirror for sinking the third current. The second sink unit may include: at least one third switch coupled to the feedback line, and being selectively turned on and turned off under a control of the controller; at least one third transistor coupled to a respective one of the at least one third switch; at least one fourth transistor coupled to the at least one third transistor as a current mirror for receiving the fourth current.

The number of the at least one third transistor coupled to the respective one of the at least one third switch is increased by a rate of $2^k$ (k=0, 1, 2, . . . ). The number of the at least one third transistor may be identical to that of the at least one fourth transistor. The second current may be a sum of the fifth current and the sixth current. One frame may be divided into a plurality of sub frames, and the sampling period may be positioned at an initial period located at the beginning of the one frame. The sensing period may correspond to a time when a power is supplied to the organic light emitting display. The organic light emitting display may further include: a data driver for supplying a first data signal and a second data signal to data lines coupled to the pixels, the first data signal for causing the pixels to be emitted and the second data signal for causing the pixels not to be emitted; a scan driver for supplying a first scan signal and a second scan signal to first scan lines and second scan lines coupled to the pixels, respectively; and a control line driver for supplying a control signal to control lines, which are coupled to the pixels.

Each of the pixels may include: a second transistor coupled to the feedback line, and turned on when the scan signal is supplied to the first scan lines; a first transistor having a gate electrode coupled to a second electrode of the second transistor and for supplying an electric current to the organic light emitting diode; a first capacitor between the gate electrode and a first electrode of the first transistor, and charged with a voltage corresponding to the second current; a third transistor between a second electrode of the first transistor and the feedback line, and turned on when the scan signal is supplied to a corresponding first scan line among the first scan lines; a fourth transistor between the first transistor and the organic light emitting diode; a second capacitor between the fourth transistor and the first electrode of the first transistor, and charged with a voltage corresponding to the first data signal or the second data signal; a fifth transistor between the fourth transistor and the data line, and turned on when the scan signal is supplied to a corresponding second scan line among the second scan lines; and a sixth transistor between an anode electrode of the organic light emitting diode and the feedback line, and turned on when the control signal is supplied to the control lines.

The fifth transistor may be turned on during the sensing period or the sampling period to receive the second data signal from the data line. The sixth transistor may be turned on during the sensing period. The second transistor and the third transistor may be turned on during the sampling period. The second capacitor may be charged with the first data signal or the second data signal when the second scan signal is sequentially supplied during at lease one of the sub frame periods.

According to another aspect in an exemplary embodiment of the present invention, there may be provided a method for driving an organic light emitting display, including: supplying a first current to organic light emitting diodes included in pixels during a sensing period; converting voltages applied to the organic light emitting diodes corresponding to the first current to digital values and storing the digital values in a memory; adjusting a second current sunk from the pixels using the digital values stored in the memory during a sampling period so that a degradation of the organic light emitting diodes are compensated; and charging the pixels with a voltage corresponding to the second current while sinking the second current.

The digital values of all the pixels may be stored in the memory during the sensing period. The sensing period may be located at a time when a power is supplied to the organic light emitting display. One frame may be divided into a plurality of sub frames, and the sampling period may be an initial period located at the beginning of the one frame. The method may further include: supplying a first data signal and a second data signal to the pixels during a scan period of the sub frame, the first data signal and the second data signal causing the pixels to be emitted and not to be emitted, respectively; and supplying the second current to the organic light emitting diodes of the pixels when the pixels receive the first data signal.

BRIEF DESCRIPTION OF THE DRAWINGS

The accompanying drawings, together with the specification, illustrate exemplary embodiments of the present invention, and, together with the description, serve to explain the principles of the present invention.

DETAILED DESCRIPTION OF EXEMPLARY EMBODIMENTS

Figure 1:
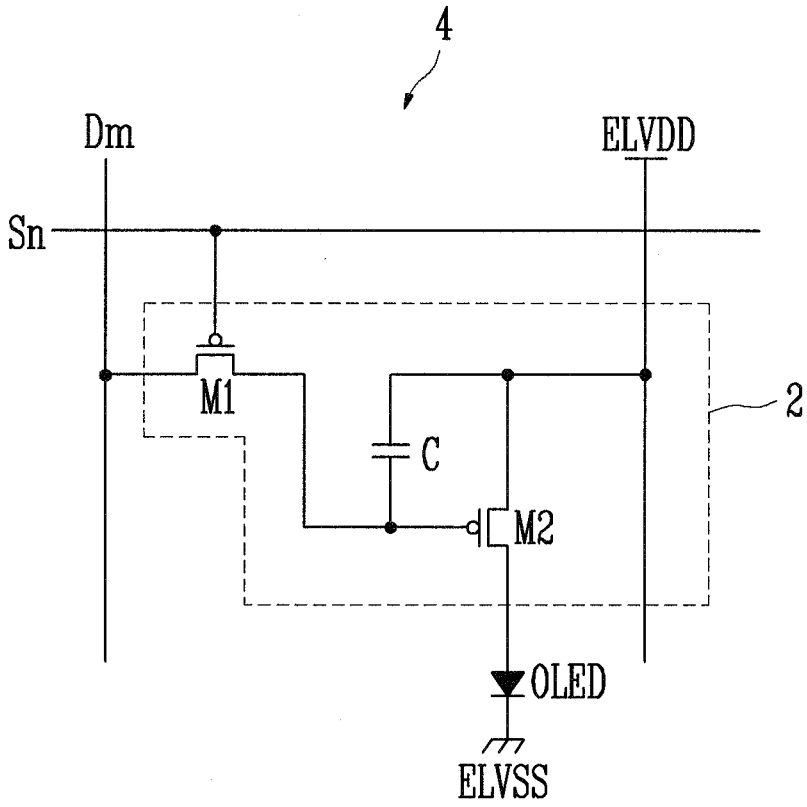
FIG. 1 (PRIOR ART)
FIG. 1 is a circuit diagram showing a pixel of a conventional organic light emitting display.

Hereinafter, certain exemplary embodiments according to the present invention will be described with reference to the accompanying drawings. Here, when a first element is described as being coupled to a second element, the first element may be not only directly coupled to the second element but may also be indirectly coupled to the second element via a third element. Further, some of the elements that are not essential to the complete understanding of the invention are omitted for clarity. Also, like reference numerals refer to like elements throughout.

Figure 2:
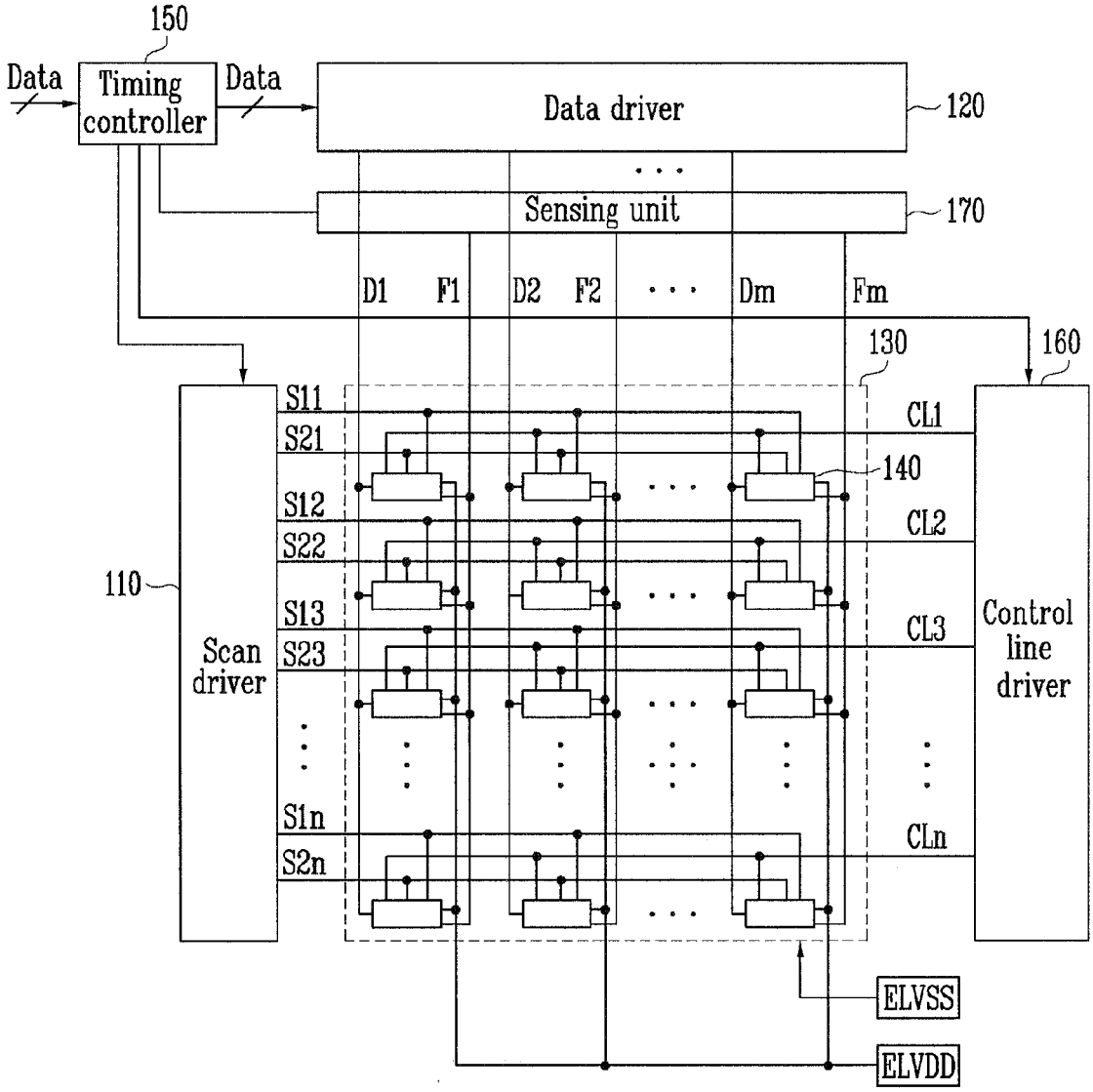
FIG. 2 is a schematic block diagram showing an organic light emitting display according to an embodiment of the present invention.

FIG. 2 is a schematic block diagram showing an organic light emitting display according to an exemplary embodiment of the present invention.

With reference to FIG. 2, the organic light emitting display according to the embodiment of the present invention includes a display portion 130 having pixels 140, a scan driver 110, a control line driver 160, a data driver 120, and a timing controller 150. The pixels 140 are coupled to first scan lines S11 through S1*n*, second scan lines S21 through S2*n*, data lines D1 through Dm, feedback lines F1 through Fm, and control lines CL1 through CLn. The scan driver 110 drives the first scan lines S11 through S1*n* and the second scan lines S21 through S2*n*. The control line driver 160 drives the control lines CL1 through CLn. The data driver 120 drives the data lines D1 through Dm. The timing controller 150 controls the scan driver 110, the control line driver 160, and the data driver 120.

The organic light emitting display according to the above embodiment of the present invention further includes a sensing unit 170. The sensing unit 170 senses degradation information of an organic light emitting diode included in each of the pixels 140 using the feedback lines F1 through Fm, and charges a voltage for compensating the degradation of the organic light emitting diode corresponding to the sensed degradation information thereof in the pixels 140.

The display portion 130 includes pixels 140, which are disposed at crossings of the first scan lines S11 through S1*n*, the second scan lines S21 through S2*n*, the data lines D1 through Dm, the feedback lines F1 through Fm, and the control lines CL1 through CLn. The pixels 140 receive a first power source ELVDD and a second power source ELVSS. The pixels 140 control an electrical coupling between the first power source ELVDD and the organic light emitting diode. In practice, the electric current supplied to the organic light emitting diodes in the pixels 140 is set to have the same value regardless of gradations (i.e., gray levels). Here, according to embodiments of the present invention, the gradations are represented by controlling an emission time of the organic light emitting diodes.

The scan driver 110 supplies a first scan signal to the first scan lines S11 to S1*n*, and supplies a second scan signal to the second scan lines S21 to S2*n*. A detailed description of the first scan signal and the second scan signal supplied from the scan driver 110 will be given later.

The control line driver 160 supplies a control signal to the control lines CL1 through CLn during a sensing period. Here, the sensing period corresponds to a time when power from a power source is applied to the organic light emitting display or some other time previously set by a user. The sensing period is when the sensing unit 170 extracts degradation information of the organic light emitting diode included in each of the pixels 140.

The data driver 120 supplies a second data signal to the data lines D1 through Dm during the sensing period. Further, the data driver 120 supplies a first data signal or a second data signal to the data lines D1 through Dm. Here, the first data signal is a voltage to cause the pixels to emit light. The second data signal is a voltage to cause the pixels not to emit light.

The sensing unit 170 extracts degradation information of the organic light emitting diode during the sensing period, and adjusts an electric current sunk by a current digital-analog converter (referred to as 'current DAC' hereinafter) (not shown) so that the extracted degradation information of the organic light emitting diode may be compensated. Further, the sensing unit 170 charges a voltage of the pixels 140 using the current DAC during the sampling period of the one frame period to compensate for the degradation of the organic light emitting diodes. The sensing unit 170 will be described in detail later.

The timing controller 150 controls the scan driver 110, the data driver 120, the control line driver 160, and the sensing unit 170. Further, the timing controller 150 transfers data Data supplied from an exterior to the data driver 120.

Figure 3:
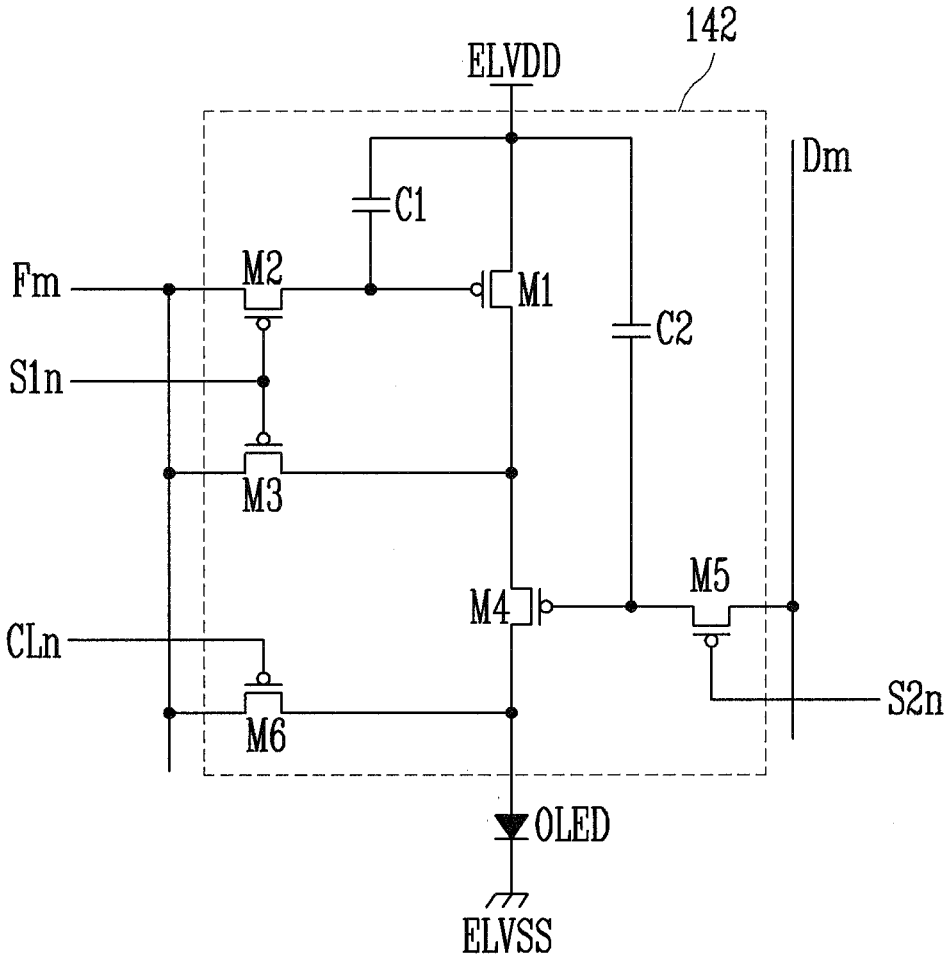
FIG. 3 is a circuit diagram showing an example of the pixel shown in FIG. 2.

FIG. 3 is a circuit diagram showing an example of the pixel 140 shown in FIG. 2. For convenience of description, FIG. 3 shows the pixel coupled to the m-th data line Dm, the first scan line S1*n* and the second scan line S2*n*.

With reference to FIG. 3, the pixel 140 according to the embodiment of the present invention includes an organic light emitting diode OLED and a pixel circuit 142. The pixel circuit 142 supplies an electric current to the organic light emitting diode OLED.

An anode electrode of the organic light emitting diode OLED is coupled to the pixel circuit 142, and a cathode electrode of the organic light emitting diode OLED is coupled to the second power source ELVSS. The organic light emitting diode OLED emits or does not emit light corresponding to an electric current supplied from the pixel circuit 142.

The pixel circuit 142 charges a voltage (e.g., a predetermined voltage) corresponding to an electric current sunk from the feedback line Fm to a first capacitor C1 when a first scan signal is supplied to the first scan line S1*n*. Further, when the second scan signal is supplied to the second scan line S2*n*, the pixel circuit 142 charges a voltage corresponding to the data signal on the data line Dm in a second capacitor C2. Here, when the first data signal is supplied on the data line Dm, the second capacitor C2 is charged with a turning-on voltage of the fourth transistor M4. In contrast to this, when the second data signal is supplied on the data line Dm, the second capacitor C2 is charged with a turning-off voltage of the fourth transistor M4. When the first data signal is supplied on the data line Dm, the pixel circuit 142 supplies an electric current corresponding to the voltage charged in the first capacitor C1 to the organic light emitting diode (OLED) for a period of time (e.g., a predetermined time). To do this, the pixel circuit 142 includes six transistors M1 through M6, the first capacitor C1, and the second capacitor C2.

A gate electrode of the second transistor M2 is coupled to the first scan line S1*n*, and a first electrode of the second transistor M2 is coupled to the feedback line Fm. Further, a second electrode of the second transistor M2 is coupled to a gate electrode of the first transistor M1 and a first terminal of the first capacitor C1. When a first scan signal is supplied to the first scan line S1*n*, the second transistor M2 is turned on.

The gate electrode of the first transistor M1 is coupled to the second electrode of the second transistor M2, and a first electrode of the first transistor M1 is coupled to a first power source ELVDD and a second terminal of the first capacitor C1. A second electrode of the first transistor M1 is coupled to a first electrode of a fourth transistor M4. The first transistor M1 supplies an electric current to the fourth transistor M4 corresponding to a voltage charged in the first capacitor C1.

A gate electrode of the third transistor M3 is coupled to the first scan line S1*n*, and a first electrode of the third transistor M3 is coupled to the second electrode of the first transistor M1. Further, a second electrode of the third transistor M3 is coupled to the feedback line Fm. When the first scan signal is supplied to the first scan line S1*n*, the third transistor M3 is turned on.

A gate electrode of the fourth transistor M4 is coupled to a second electrode of the fifth transistor M5, and a first electrode of the fourth transistor M4 is coupled to the second electrode of the first transistor M1. Further, a second electrode of the fourth transistor M4 is coupled to an anode electrode of the organic light emitting diode OLED. The fourth transistor M4 is turned on/off according to a voltage charged in the second capacitor C2.

A gate electrode of the fifth transistor M5 is coupled to a second scan line S2*n*, and a first electrode of the fifth transistor M5 is coupled to a data line Dm. Further, a second electrode of the fifth transistor M5 is coupled to the gate electrode of the fourth transistor M4. When a second scan signal is supplied to the second scan line S2*n*, the fifth transistor M5 is turned on.

A gate electrode of the sixth transistor M6 is coupled to a control line CLn, and a first electrode of the sixth transistor M6 is coupled to the feedback line Fm. Further, a second electrode of the sixth transistor M6 is coupled to the anode electrode of the organic light emitting diode OLED. When a control signal is supplied to the control line CLn, the sixth transistor M6 is turned on.

The first capacitor C1 is coupled between the gate electrode and the first electrode of the first transistor M1. The first capacitor C1 is charged with a voltage applied to the gate electrode of the first transistor M1 corresponding to an electric current that is sunk in the feedback line Fm.

The second capacitor C2 is coupled between the first power source ELVDD and the gate electrode of the fourth transistor M4. The second capacitor C2 is charged with a voltage corresponding to a data signal from the data line Dm. Here, the second capacitor C2 is charged with a voltage capable of turning on the fourth transistor M4 when the first data signal is supplied thereto. In contrast to this, the second capacitor C2 is charged with a voltage capable of turning off the fourth transistor M4 when the second data signal is supplied thereto.

Figure 4:
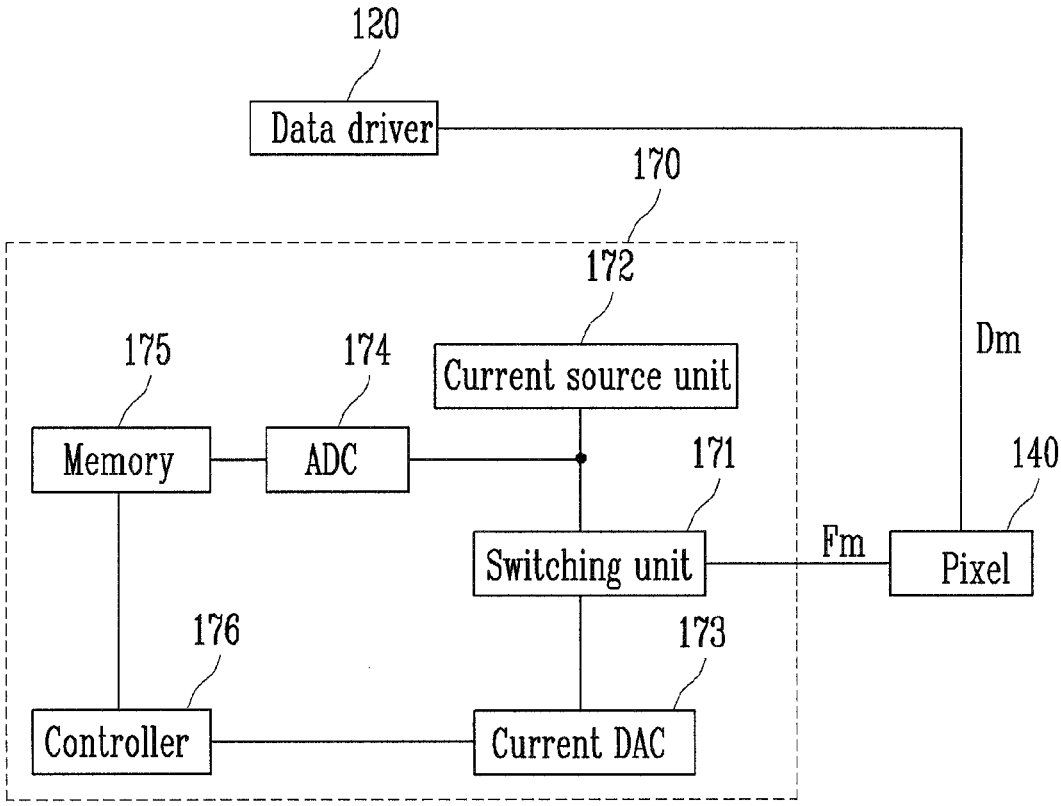
FIG. 4 is a block diagram showing the sensing unit shown in FIG. 2.

FIG. 4 is a block diagram showing the sensing unit 170 shown in FIG. 2. For convenience of description, FIG. 4 shows the sensing unit coupled to an m-th feedback line Fm.

With reference to FIG. 4, the sensing unit 170 includes multiple channels, each channel coupled to a respective one of feedback lines F1 to Fm. Each channel of the sensing unit 170 includes a switching unit 171, a current source unit 172, and a current DAC 173. Further, the sensing unit 170 includes an analog-digital converter (referred to as 'ADC') 174, a memory 175, and a controller 176, which are coupled to the switching unit 171 in common to each channel. In other words, the ADC 174, the memory 175 and the controller 176 are shared by all channels of the sensing unit 170. Here, the ADC 174 is coupled in common to all channels of the sensing unit 170 according to the described embodiment of the present invention. However, the present invention is not limited thereto. For example, another embodiment of the present invention may include three ADCs 174, which are respectively coupled to a red pixel, a green pixel, and a blue pixel.

Figure 5:
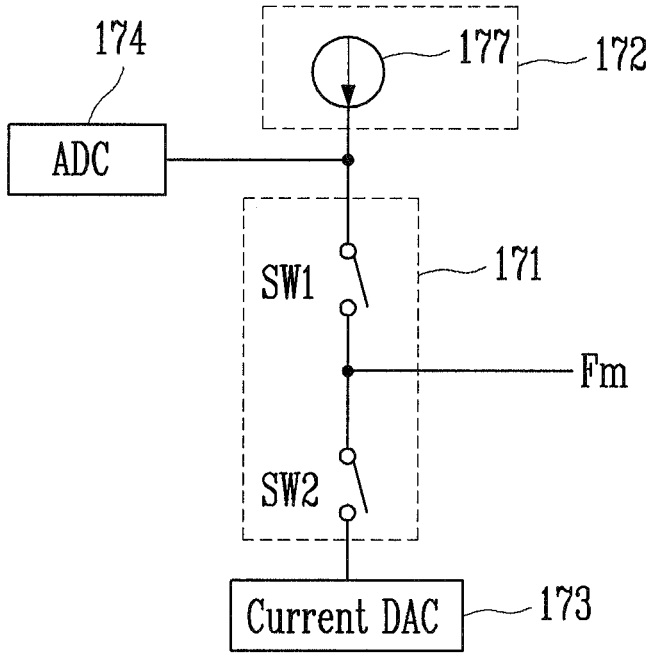
FIG. 5 is a schematic circuit diagram showing the switching unit shown in FIG. 4.

As shown in FIG. 5, an exemplary embodiment of the switching unit 171 includes a first switch SW1 and a second switch SW2. The first switch SW1 is coupled between the feedback line Fm and the current source unit 172. The second switch SW2 is coupled between the feedback line Fm and the current DAC 173.

The first switch SW1 is turned on during the sensing period. When the first switch SW1 is turned on, the feedback line Fm is electrically coupled to the current source unit 172 and the ADC 174.

The second switch SW2 is turned on during the sampling period. When the second switch SW2 is turned on during the sampling period, the feedback line Fm and the current DAC 173 are electrically coupled to each other. Here, the sampling period is an initial period located at the beginning of one frame period. A detailed description of the sampling period will be given later.

The current source unit 172 supplies an approximately constant current to the feedback line Fm. To do this, the current source unit 172 includes a current source 177. The current source 177 supplies a current (e.g., a predetermined current) to the feedback line Fm. Here, the current value of the current source 177 causes a voltage corresponding to degradation information to the organic light emitting diode OLED. In practice, the current value of the current source 177 may be experimentally and variously set so that a suitable voltage (e.g., a predetermined voltage) is applied to the organic light emitting diode OLED. For example, the current value of the current source 177 in one embodiment is a current value of a current that should flow to the organic light emitting diode OLED when the organic light emitting diode OLED is not degraded.

The ADC 174 converts the voltage applied to the organic light emitting diode OLED to a digital value when the electric current is supplied from the current source unit 172 to the pixel 140.

The memory 175 stores the digital value supplied from the ADC 174. According to one embodiment, the memory 175 has a capacity to include digital values of all the pixels 140 included in the display portion 130.

The controller 176 determines degradation information of an organic light emitting diode OLED included in each of pixels 140 using the digital values stored in the memory 175, and controls the current DAC 173 to compensate for the determined degradation information of the organic light emitting diode OLED.

In detail, when an electric current is supplied from the current source unit 172 to the pixel 140, a suitable voltage (e.g., a predetermined voltage) is applied to the organic light emitting diode OLED. Here, the more the organic light emitting diode OLED has degraded, the greater the voltage applied to the organic light emitting diode OLED is. Accordingly, the digital values stored in the memory 175 include the degradation information of the organic light emitting diode OLED. For example, when the organic light emitting diode OLED is not degraded a value of "0000" is stored in the memory. In contrast to this, when the organic light emitting diode OLED is degraded, a value of "0010" may be stored in the memory. In this case, the controller 176 controls the current DAC 173 so that the degradation of the organic light emitting diode OLED can be compensated corresponding to the digital value.

The current DAC 173 sinks a current (e.g., a predetermined current) from the pixel 140. Here, the current DAC 173 sinks an electric current (referred to as 'Imax'), which should flow to the organic light emitting diode OLED when the organic light emitting diode OLED is not degraded, namely, a maximum current, which should flow across the organic light emitting diode to express required luminance. Accordingly, the first capacitor C1 included in the pixel 140 is charged with a voltage corresponding to the maximum current Imax.

Meanwhile, the current DAC 173 sinks α+Imax current so that the degradation of the organic light emitting diode OLED can be compensated under a control of the controller 176 when the organic light emitting diode OLED is degraded. Here, a is an electric current added to compensate for the degradation of the organic light emitting diode OLED. The first capacitor C1 included in a pixel 140 to which the electric current of α+Imax from the current DAC 173 is supplied, is charged with a voltage corresponding to the electric current of α+Imax. Accordingly, an electric current from the first transistor M1 to the organic light emitting diode OLED is set so that the degradation of the organic light emitting diode OLED can be compensated.

Figure 6:
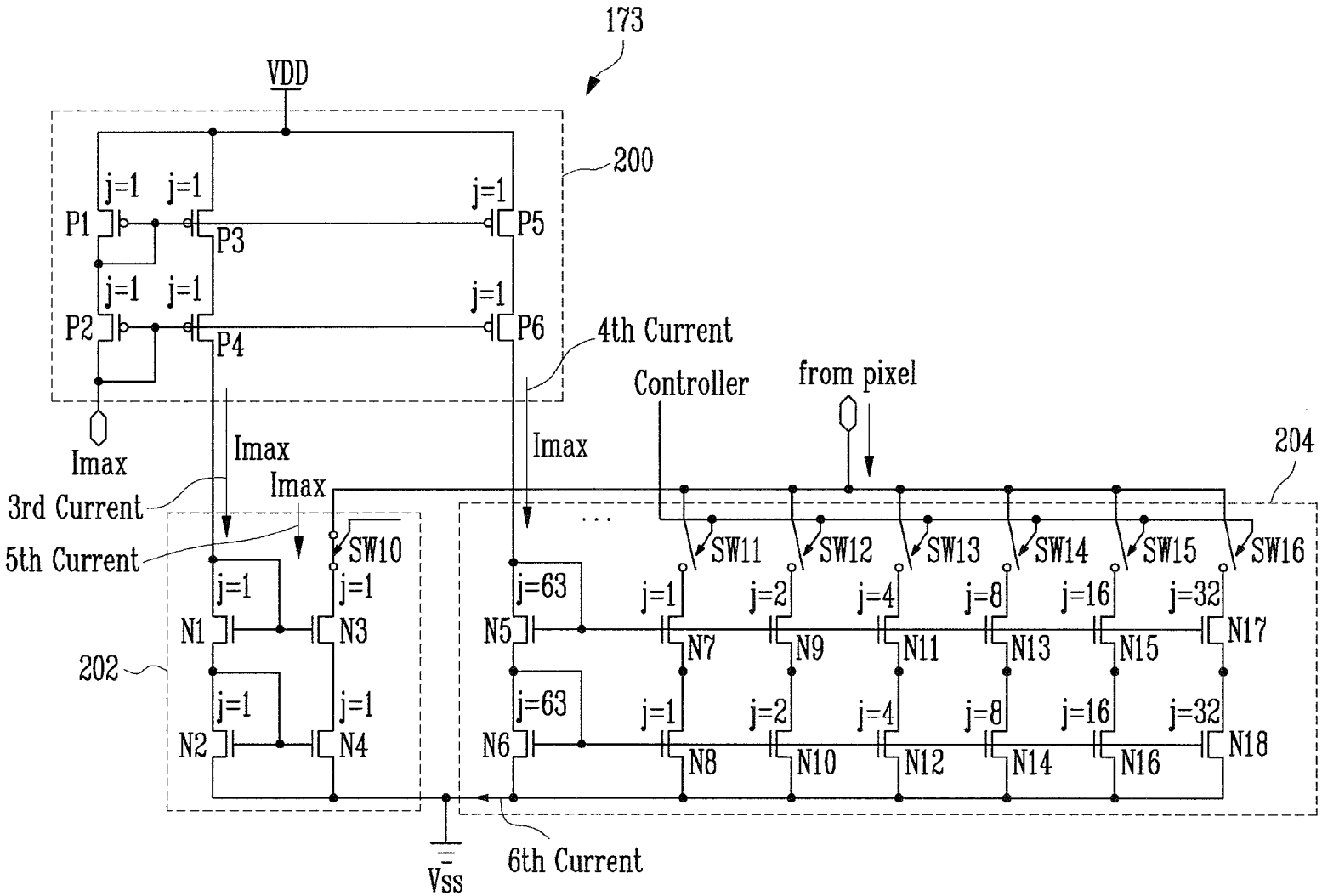
FIG. 6 is a schematic circuit diagram showing the current digital-analog converter shown in FIG. 4.

FIG. 6 is a schematic circuit diagram showing the current digital-analog converter shown in FIG. 4. In FIG. 6, 'j' represents the number of transistors.

With reference to FIG. 6, the current DAC 173 according to one embodiment of the present invention includes a current generator 200, a first sink unit 202, and a second sink unit 204. The first sink unit 202 is coupled to the current generator 200, and sinks the Imax current from a pixel 140. The second sink unit 240 is coupled to the current generator 200, and sinks α current from the pixel 140.

The current generator 200 generates Imax current. To do this, the current generator 200 includes P1 through P6 transistors. The P1 transistor and the P2 transistor are diode-connected, and channel widths thereof are set so that Imax current can flow from a third power source VDD.

The P3 transistor and the P4 transistor are serially coupled to the third power source VDD and the first sink unit 202. Here, the P3 transistor is coupled to the P1 transistor as a current mirror. The P4 transistor is coupled to the P2 transistor as a current mirror. The P3 and P4 transistors supply Imax current to the first sink unit 202.

The P5 transistor and the P6 transistor are serially coupled to the third power source VDD and the second sink unit 204. Here, the P5 transistor is coupled to the P1 transistor as a current mirror. The P6 transistor is coupled to the P2 transistor as a current mirror. The P5 and P6 transistors supply Imax current to the second sink unit 204.

The first sink unit 202 sinks Imax current from the pixel 140. To do this, the first sink unit 202 included N1 through N4 transistors. The N1 and N2 transistors are diode-connected between the P4 transistor of the current generator 200 and a fourth power source VSS. The N1 and N2 transistors supply the Imax current from the current generator 200 to the fourth power source VSS.

The N3 and N4 transistors are coupled between the switching unit 171 and the fourth power source VSS. Here, the N3 transistor is coupled to the N1 transistor as a current mirror. The N4 transistor is coupled to the N2 transistor as a current mirror. Accordingly, the N3 and N4 transistors sink an electric current corresponding to Imax from the pixel 140 through the switching unit 171 and the feedback line Fm.

Further, a tenth switch SW10 is disposed between the N3 transistor and the switching unit 171. The tenth switch SW10 always maintains a turned on state. The tenth switch SW10 is used to match resistance with switches SW11 through SW16 included in the second sink unit 204.

The second sink unit 204 sinks a current from the pixel 140. In detail, the second sink unit 204 includes the N5 transistors and the N6 transistors, which are serially formed between the current generator 200 and the fourth power source VSS. Here, the N5 transistors are coupled to each other in parallel. For example, the N5 transistors are composed of 63 transistors, which are coupled to each other in parallel. Accordingly, one-sixty third of the Imax current flows through each of the 63 N5 transistors. In the same manner, the N6 transistors are composed of 63 transistors, which are coupled to each other in parallel. Accordingly, one-sixty third of the Imax current flows through each of the 63 N6 transistors. The number of the N5 transistors and the number of the N6 transistors can be variously set. However, the same number of N5 and N6 transistors is set by the corresponding number of transistors N7 through N18, which are coupled to the switches SW11 through SW16.

Further, the second sink unit 204 includes an eleventh switch SW11 through a sixteenth transistor SW16, and a seventh transistor N7 through an eighteenth transistor N18. The eleventh switch SW11 through the sixteenth transistor SW16 are coupled to the switching unit 171. The seventh transistor N7 through an eighteenth transistor N18 are coupled between each of the eleventh switch SW11 through the sixteenth transistor SW16 and the fourth power source VSS.

Here, the number of transistors coupled to each of the eleventh switch SW11 through the sixteenth transistor SW16 is set to be increased at a rate of $2^k$ (k=0, 1, 2, 3, . . . ). In detail, one N7 transistor and one N8 transistor are formed between the eleventh transistor SW11 and the fourth power source VSS. The N7 transistor defines a current mirror with the N5 transistors. The N8 transistor defines a current mirror with the N6 transistors. Accordingly, when the eleventh transistor SW11 is turned on, one-sixty third of the Imax current from the pixel 140 is additionally sunk. In the described embodiment of the present invention, transistors are serially coupled between the eleventh switch S11 through the sixteenth transistor S16 and the fourth power source VSS for stability reasons. However, the present invention is not limited thereto. By way of example, in another embodiment, only the N7 transistor may be formed between the eleventh transistor SW11 and the fourth power source VSS. In other words, the N8 transistor may be removed in another embodiment. In this case, N6, N10, N12, N14, N16, N18, N4, and N2 transistors are also removed.

Two N9 transistors and two N10 transistors are serially formed between the twelfth switch SW12 and the fourth power source VSS. Here, the N9 transistors are coupled to each other in parallel, and the N10 transistors are coupled to each other in parallel. The N9 transistors form a current mirror with the N5 transistors. The N10 transistors form a current mirror with the N6 transistors. Accordingly, when the twelfth switch SW12 is turned on, two-sixty third of the Imax current from the pixel 140 is additionally sunk.

Four N11 transistors and four N12 transistors are serially formed between the thirteenth switch SW13 and the fourth power source VSS. The N11 transistors form a current mirror with the N5 transistors. The N12 transistors form a current mirror with the N6 transistors. Accordingly, when the thirteenth switch SW13 is turned on, four-sixty third of the Imax current from the pixel 140 is additionally sunk.

Eight N13 transistors and eight N14 transistors are serially formed between the fourteenth switch SW14 and the fourth power source VSS. The N13 transistors form a current mirror with the N5 transistors. The N14 transistors form a current mirror with the N6 transistors. Accordingly, when the fourteenth switch SW14 is turned on, eight-sixty third of the Imax current from the pixel 140 is additionally sunk.

Sixteen N15 transistors and sixteen N16 transistors are serially formed between the fifteenth switch SW15 and the fourth power source VSS. The N15 transistors form a current mirror with the N5 transistors. The N16 transistors form a current mirror with the N6 transistors. Accordingly, when the fifteenth switch SW15 is turned on, sixteen-sixty third of the Imax current from the pixel 140 is additionally sunk.

Thirty two N17 transistors and thirty two N18 transistors are serially formed between the sixteenth switch SW16 and the fourth power source VSS. The N17 transistors form a current mirror with the N5 transistors. The N18 transistors form a current mirror with the N6 transistors. Accordingly, when the sixteenth switch SW16 is turned on, thirty two-sixty third of the Imax current from the pixel 140 is additionally sunk.

Meanwhile, the eleventh switch SW11 through the sixteenth switch SW16 are turned on/off under a control of the controller 176. The controller 176 controls the eleventh switch SW11 through the sixteenth switch SW16 so that a current to compensate for the degradation of the organic light emitting diode OLED of the pixel 140 can flow.

Figure 7:
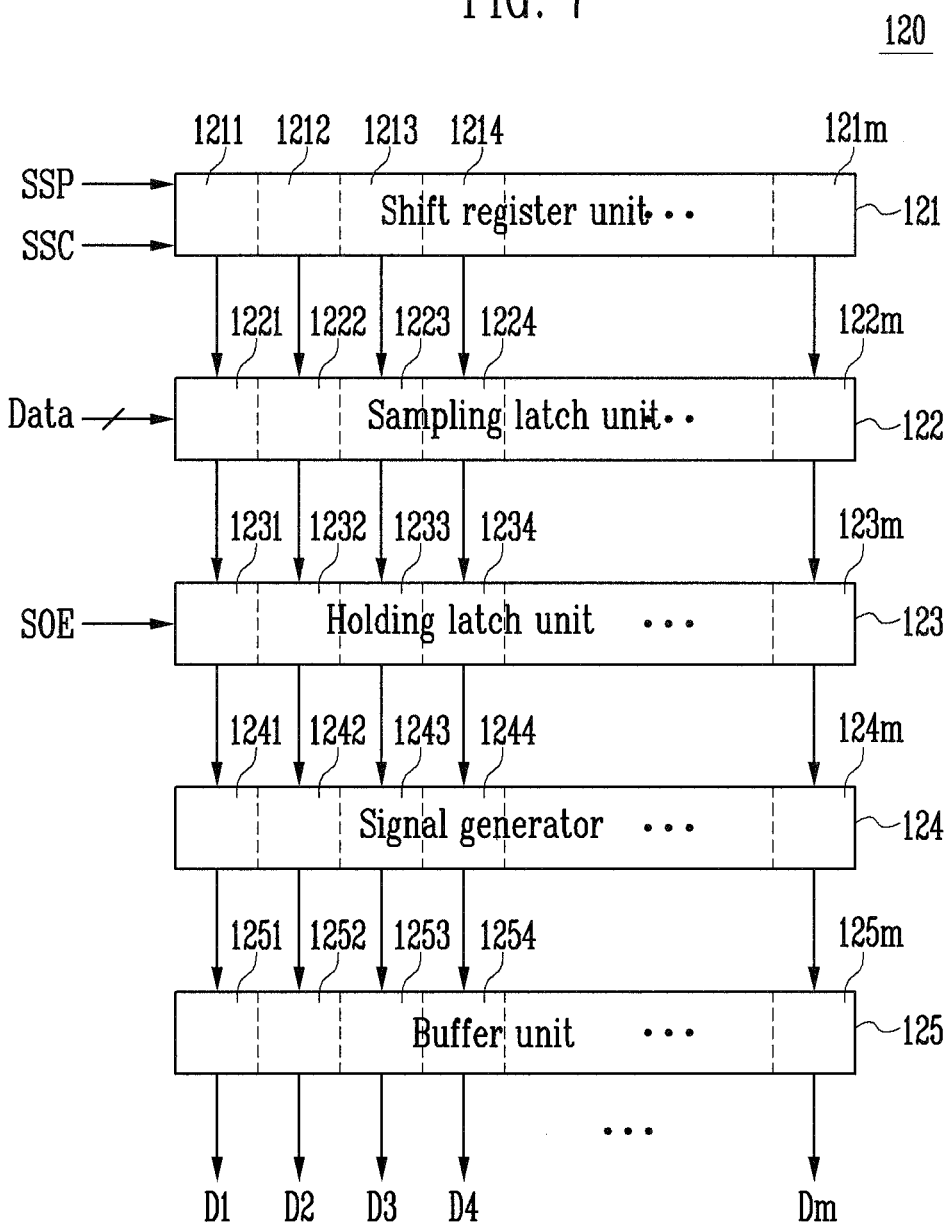
FIG. 7 is a block diagram showing the data driver shown in FIG. 2.

FIG. 7 is a block diagram showing the data driver shown in FIG. 2. With reference to FIG. 7, the data driver 120 includes a shift register unit 121, a sampling latch unit 122, a holding latch unit 123, a signal generator 124, and a buffer unit 125.

The shift register unit 121 receives a source start pulse SSP and a source shift clock SSC from the timing controller 150. When the shift register unit 121 receives the source start pulse SSP and the source shift clock SSC, it sequentially generates m sampling signals while shifting the source start pulse SSP every period of the source shift clock SSC. To perform this operation, the shift register unit 121 includes m shift registers 1211 through 121*m*.

The sampling latch unit 122 sequentially stores data Data in response to the sampling signals, which are sequentially supplied from the shift register unit 121. To perform this operation, the sampling latch unit 121 includes m sampling latches 1212 through 122*m* to store m data Data.

The holding latch unit 123 receives a source output enable signal SOE from the timing controller 150. When the holding latch unit 123 receives the source output enable signal SOE, it receives and stores data Data from the sampling latch unit 122. Further, the holding latch 123 supplies the data Data stored therein to the signal generator 124. To perform this operation, the holding latch unit 123 includes m holding latches 1231 through 123*m*.

The signal generator 124 receives the data Data from the holding latch unit 123, and generates m data signals corresponding to the received data Data. To perform this operation, the signal generator 124 includes m pulse generators 1241 through 124*m*. That is, the signal generator 124 generates m data signals using the pulse generators 1241 through 124*m* positioned every channel, and provides the m data signals to the buffer unit 125.

The buffer unit 125 provides the m data signals from the signal generator 124 to m data lines D1 through Dm. To do this, the buffer unit 125 includes m buffers 1251 through 125*m*.

Figure 8A:
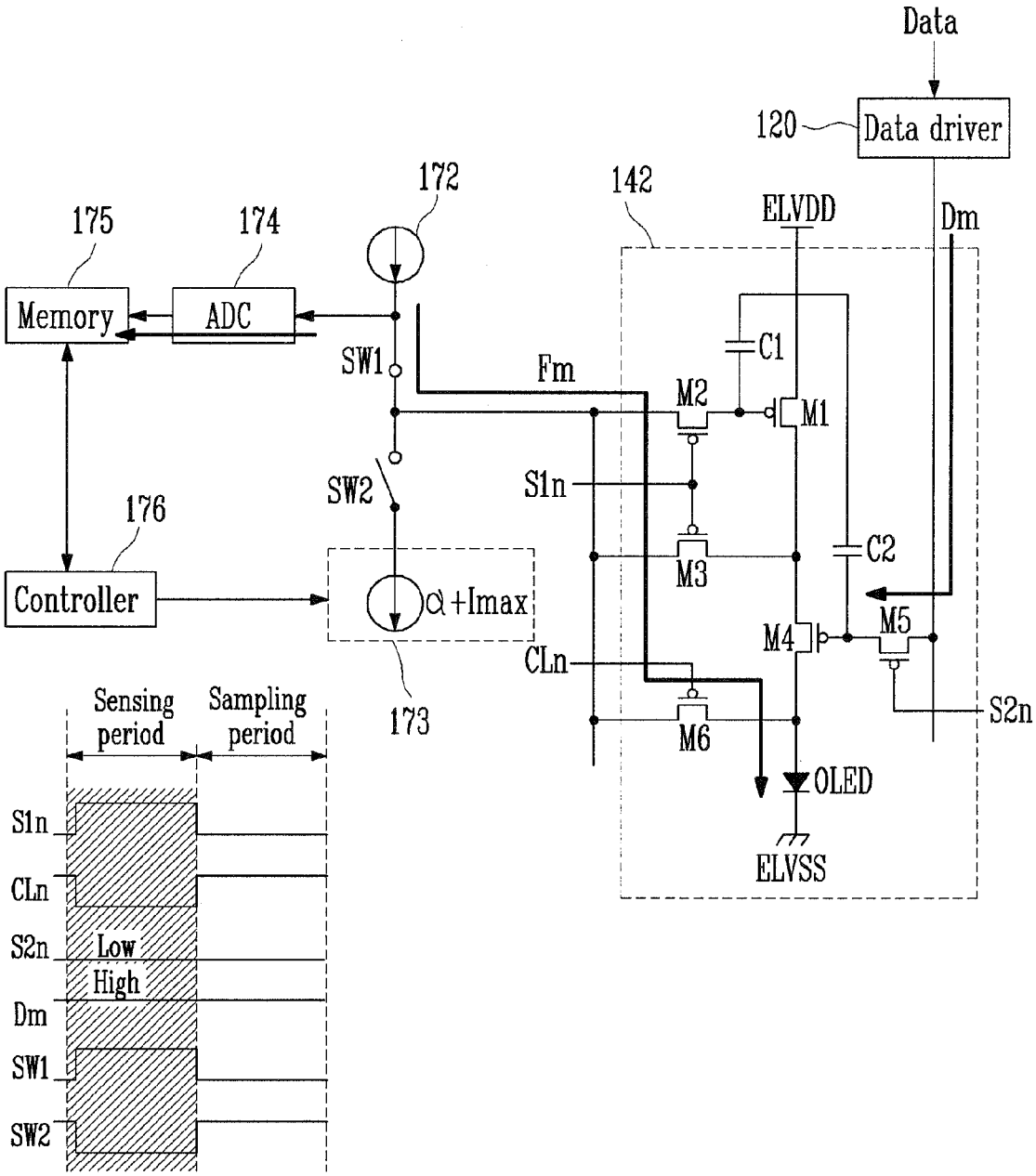
FIG. 8A and FIG. 8B are schematic block diagrams for illustrating a method for driving the organic light emitting display according to an embodiment of the present invention.
Figure 8B:
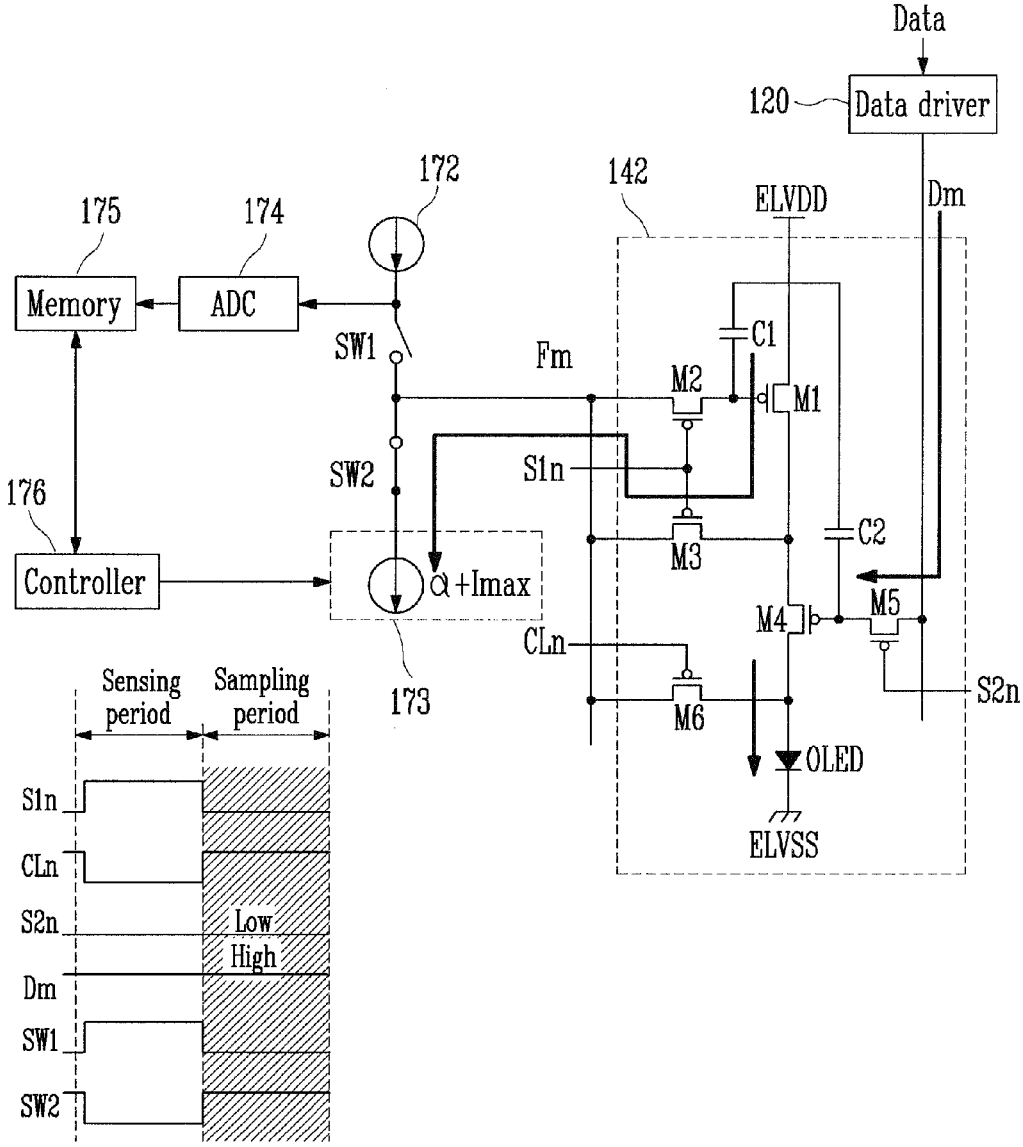

FIG. 8A and FIG. 8B are schematic block diagrams for illustrating a method for driving the organic light emitting display according to an embodiment of the present invention. For convenience of description, FIG. 8A and FIG. 8B show a pixel coupled to an m-th data line Dm and a first scan line S1*n*.

Referring to FIG. 8A and FIG. 8B, a second scan signal is supplied to a second scan line S2*n*, and a control signal is supplied to a control line CLn during the sensing period. When the first switch SW1 is turned on during the sensing period, the second data signal is supplied to the data line Dm.

When the second scan signal is supplied to the second scan line S2*n*, the fifth transistor M5 is turned on. When the fifth transistor M5 is turned on, the second capacitor C2 is charged with a voltage corresponding to the second data signal supplied to the data line Dm. Accordingly, the fourth transistor M4 maintains a turned off state during the sensing period.

When the control signal is supplied to the control line CLn, the sixth transistor M6 is turned on. At this time, because the first switch SW1 is turned on, an electric current from the current source unit 172 is provide to the organic light emitting diode OLED through the feedback line Fm and the sixth transistor M6. Further, a voltage (e.g., a predetermined voltage) corresponding to an electric current supplied from the current source unit 172 is applied to the organic light emitting diode OLED. The ADC 174 converts voltage applied to the organic light emitting diode OLED to a digital value, and stores the digital value in the memory 175.

In practice, during the sensing period, the aforementioned procedure repeats to store digital values of all the pixels 140 in the memory 175.

In the embodiment where the ADC 174 is coupled to all channels in common, the first switch SW1 is sequentially turned on, which is located at every channel. In detail, a control signal is sequentially supplied to horizontal lines (e.g., control lines). For example, if a control signal is supplied to a j-th control line CLj, a sixth transistor M6 included in each of the pixels 140 positioned at a j-th horizontal line is turned on. Here, 'j' is a natural number. Next, the first switches SW1 coupled to the first feedback line F1 to the m-th feedback line Fm are turned on. Accordingly, a digital value of the pixel 140 coupled to the first feedback line F1 to a digital value of the pixel coupled to the m-th feedback line Fm are sequentially stored in the memory 175.

Subsequently, during the sampling period as shown in FIG. 8B, a first scan signal is supplied to the first scan line S1*n*, and a second scan signal is supplied to the second scan line S2*n*. Further, during the sampling period, the second switch SW2 is turned on and concurrently the second data signal is supplied to the data line Dm.

When the second scan signal is supplied to the second scan line S2*n*, the fifth transistor M5 is turned on. When the fifth transistor M5 is turned on, the second capacitor C2 is charged with a voltage corresponding to the second data signal supplied to the data line Dm. Accordingly, the fourth transistor M4 maintains a turned off state during the sampling period.

When the first scan signal is supplied to the first scan line S1*n*, the second transistor M2 and the third transistor M3 are turned on. Accordingly, the feedback line Fm and a gate electrode and a second electrode of the first transistor M1 are electrically coupled to each other.

Here, the controller 176 extracts a digital value corresponding to a pixel 140, which is coupled to a feedback line Fm from the memory 175.

Next, the controller 176 controls turn-on/off of the eleventh switch SW11 through the sixteenth switch SW16 so that the degradation of the pixel 140 may be compensated.

Accordingly, $\alpha$+Imax current for compensating the degradation of the organic light emitting diode OLED is sunk in the current DAC 173. In practice, the $\alpha$+Imax current sunk in the current DAC 173 is provided to the current DAC 173 through a first power source ELVDD, the first transistor M1, the third transistor M3, the feedback line Fm, and the second switch SW2. Accordingly, a voltage corresponding to the electric current α+Imax is applied to a gate electrode of the first transistor M1, and the first capacitor C1 is charged with the voltage.

In practice, while the aforementioned operation repeats during the sampling period, each capacitor C1 of all the pixels 140 is charged with a suitable voltage (e.g., predetermined voltage). In detail, during the sampling period, a first scan signal is sequentially supplied to the first scan lines S11 to S1*n*, and a second scan signal is sequentially supplied to the second scan lines S21 to S2*n*.

Here, the controller 176 controls the current DAC 173 located at every channel to sink an electric current capable of compensating the degradation of the organic light emitting diode OLED from each pixel 140.

Figure 9:
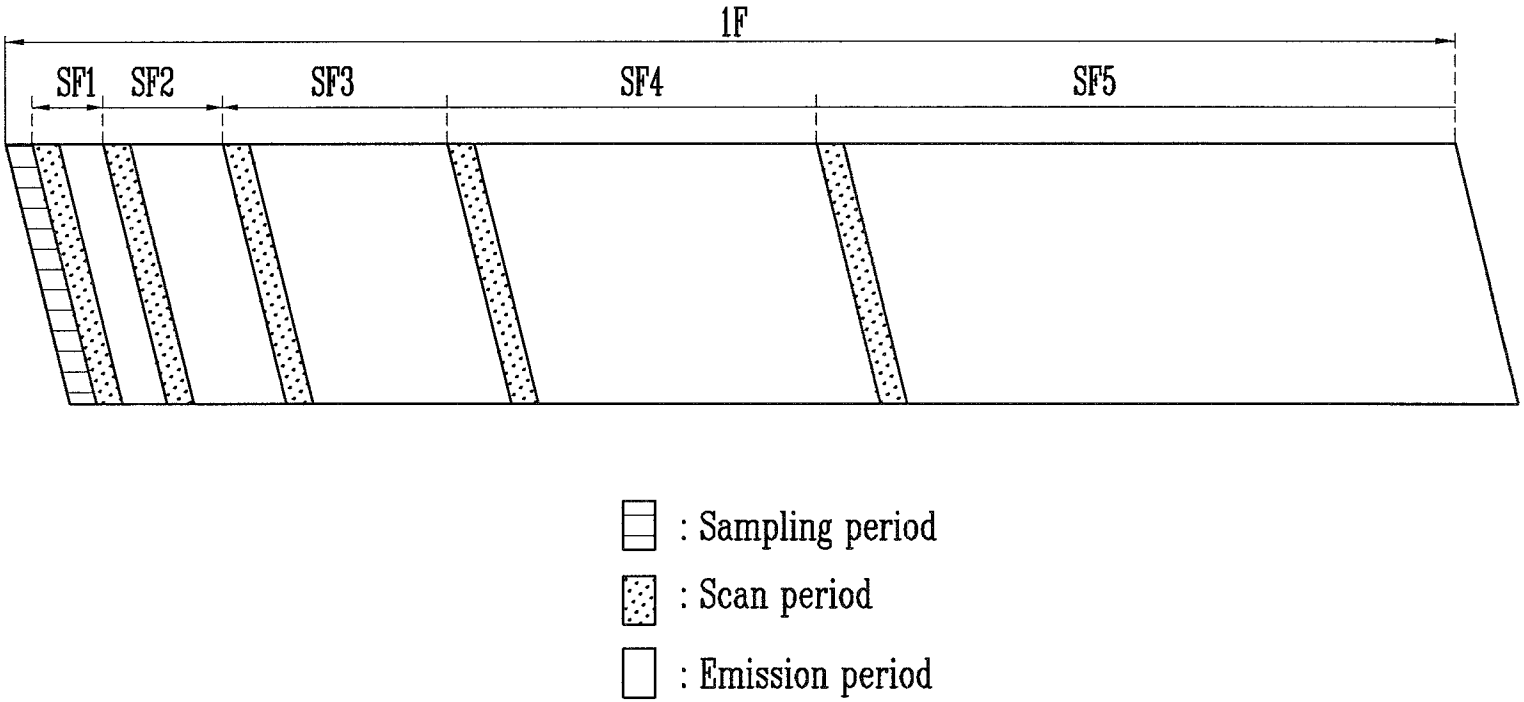
FIG. 9 is illustrates one frame which is used in an exemplary embodiment according to the present invention.

FIG. 9 illustrates one frame which is used in exemplary embodiments according to the present invention. With reference to FIG. 9, each frame includes a sampling period and a plurality of sub frames SF1 through SF5. The sampling period is located prior to the sub frames SF1 through SF5, and the first capacitor C1 included in each pixel 140 is charged with a suitable voltage (e.g., predetermined voltage) during the sampling period.

The sub frames SF1 through SF5 are driven to be divided into a scan period and an emission period. During the scan period, a second scan signal is sequentially supplied to second scan lines S21 through S2*n*. Further, a data signal is supplied to data lines D1 through Dm in synchronization with the second scan signal. Accordingly, the second capacitor C2 included in each pixel 140 is charged with a voltage corresponding to a first data signal or a second data signal.

During the emission period, the fourth transistor M4 is turned on or turned off according to a voltage charged in the second capacitor C2. When the fourth transistor M4 is turned off, the pixel 140 is set as a non-emission state during a corresponding sub frame period. When the fourth transistor M4 is turned on, an electric current corresponding to the voltage charged in the first capacitor C1 form the first transistor M1 to the organic light emitting diode OLED, so that the organic light emitting diode OLED is set at an emission state.

Meanwhile, because the voltage charged in the first capacitor C1 is a voltage corresponding to the electric current of (α+Imax), an electric current capable of compensating the degradation of the organic light emitting diode OLED is provided to the organic light emitting diode OLED, so that light of desired luminance is generated. Moreover, because the first capacitor C1 is charged with a voltage corresponding to the sunk current through the first transistor M1, images of substantially uniform luminance can be displayed regardless of non-uniformity in a threshold voltage and a mobility deviation of the first transistor M1.

As seen from the forgoing description, in the organic light emitting display and a method of driving the same, a voltage applied to the organic light emitting diode is converted to a digital value and the digital value is stored in a memory while supplying an electric current to the organic light emitting diode. Next, an amount of an electric current sunk from a pixel is adjusted corresponding to the stored digital value in the memory so that degradation of the organic light emitting diode may be compensated. Accordingly, the degradation of the organic light emitting diode is compensated, so that images of desired luminance can be displayed.

Although exemplary embodiments of the present invention have been shown and described, it would be appreciated by those skilled in the art that changes might be made in these embodiments without departing from the principles and spirit of the invention, the scope of which is defined in the claims and their equivalents.

What is claimed is:

1. An organic light emitting display comprising:

a plurality of pixels, each pixel comprising an organic light emitting diode and a pixel circuit for controlling a supply of an electric current to the organic light emitting diode;

a sensing unit for supplying a first current via a first current path to the organic light emitting diode in each of the pixels and converting a voltage applied to the organic light emitting diode to a respective one of digital values during a sensing period, and configured to receive and sink a second current via a second current path from each of the pixels corresponding to the respective one of the digital values to compensate for a degradation of the organic light emitting diode during a sampling period; and a data driver configured to supply data signals to the pixels.

2. The organic light emitting display as claimed in claim 1, wherein the sensing unit comprises:

a current source unit for supplying the first current;

a current digital-analog converter for sinking the second current;

a switching unit for selectively coupling the current source unit and the current digital-analog converter to a feedback line among a plurality of feedback lines, wherein each of the feedback lines is coupled to at least one pixel among the plurality of pixels;

an analog-digital converter coupled to the current source unit for converting a voltage applied to the organic light emitting diode to the respective one of the digital values;

a memory for storing the digital values; and a controller for controlling an amount of the second current sunk by the current digital-analog converter corresponding to the respective one of the digital values stored in the memory.

3. The organic light emitting display as claimed in claim 2, wherein the sensing unit further comprises a plurality of channels, each channel coupled to a respective one of the feedback lines, and each channel including the current source unit, the switching unit, and the current digital-analog converter.

4. The organic light emitting display as claimed in claim 2, wherein the switching unit comprises:

a first switch between the feedback line and the current source unit; and a second switch between the feedback line and the current digital-analog converter.

5. The organic light emitting display as claimed in claim 4, wherein the first switch is turned on during the sensing period, and the second switch is turned on during the sampling period.

6. The organic light emitting display as claimed in claim 2, wherein one frame is divided into a plurality of sub frames, and the sampling period is an initial period located at the beginning of the one frame.

7. The organic light emitting display as claimed in claim 6, wherein the data driver is configured to supply a first data signal of the data signals and a second data signal of the data signals to data lines coupled to the pixels, the first data signal for causing the pixels to emit light and the second data signal for causing the pixels to not emit light;

a scan driver for supplying a first scan signal and a second scan signal to first scan lines and second scan lines coupled to the pixels, respectively; and a control line driver for supplying a control signal to control lines, which are coupled to the pixels.

8. The organic light emitting display as claimed in claim 2, wherein the sensing period corresponds to a time when a power is supplied to the organic light emitting display.

9. The organic light emitting display as claimed in claim 1, wherein the sensing unit comprises a current source for supplying the first current.

10. An organic light emitting display comprising:

a plurality of pixels, each pixel comprising an organic light emitting diode and a pixel circuit for controlling a supply of an electric current to the organic light emitting diode; and a sensing unit for supplying a first current to the organic light emitting diode in each of the pixels and converting a voltage applied to the organic light emitting diode to a respective one of digital values during a sensing period, and for sinking a second current from each of the pixels corresponding to the respective one of the digital values to compensate for a degradation of the organic light emitting diode during a sampling period, wherein the sensing unit comprises:

a current source unit for supplying the first current;

a current digital-analog converter for sinking the second current;

a switching unit for selectively coupling the current source unit and the current digital-analog converter to a feedback line among a plurality of feedback lines;

an analog-digital converter coupled to the current source unit for converting a voltage applied to the organic light emitting diode to the respective one of the digital values;

a memory for storing the digital values; and a controller for controlling an amount of the second current sunk by the current digital-analog converter corresponding to the respective one of the digital values stored in the memory, wherein each of the feedback lines is coupled to at least one pixel among the plurality of pixels, and wherein the current digital-analog converter comprises:

a current generator for generating a third current and a fourth current, the third current and the fourth current each corresponding to a current to flow to the organic light emitting diode before the organic light emitting diode is degraded;

a first sink unit for sinking a fifth current from the feedback line corresponding to the third current supplied by the current generator; and a second sink unit for sinking a sixth current in accordance with the degradation of the organic light emitting diode from the feedback line and based on the fourth current supplied by the current generator.

11. The organic light emitting display as claimed in claim 10, wherein the first sink unit comprises:

at least one first transistor being diode-connected for receiving the third current; and at least one second transistor coupled to the first transistor as a current mirror for sinking the fifth current.

12. The organic light emitting display as claimed in claim 10, wherein the second sink unit comprises:

at least one third switch coupled to the feedback line, and being selectively turned on and turned off under a control of the controller;

at least one third transistor coupled to a respective one of the at least one third switch; and at least one fourth transistor coupled to the at least one third transistor to form a current mirror, the at least one fourth transistor for receiving the fourth current.

13. The organic light emitting display as claimed in claim 12, wherein the number of the at least one third transistor coupled to the respective one of the at least one third switch is increased by a rate of $2^k$ (k=0, 1, 2, . . . ).

14. The organic light emitting display as claimed in claim 12, wherein the number of the at least one third transistor is identical to the number of the at least one fourth transistor.

15. The organic light emitting display as claimed in claim 10, wherein the second current is a sum of the fifth current and the sixth current.

16. An organic light emitting display comprising:

a plurality of pixels, each pixel comprising an organic light emitting diode and a pixel circuit for controlling a supply of an electric current to the organic light emitting diode;

a sensing unit for supplying a first current to the organic light emitting diode in each of the pixels and converting a voltage applied to the organic light emitting diode to a respective one of digital values during a sensing period, and for sinking a second current from each of the pixels corresponding to the respective one of the digital values to compensate for a degradation of the organic light emitting diode during a sampling period;

a data driver for supplying a first data signal and a second data signal to data lines coupled to the pixels, the first data signal for causing the pixels to be emitted and the second data signal for causing the pixels not to be emitted;

a scan driver for supplying a first scan signal and a second scan signal to first scan lines and second scan lines coupled to the pixels, respectively; and a control line driver for supplying a control signal to control lines, which are coupled to the pixels, wherein the sensing unit comprises:

a current source unit for supplying the first current;

a current digital-analog converter for sinking the second current;

a switching unit for selectively coupling the current source unit and the current digital-analog converter to a feedback line among a plurality of feedback lines;

an analog-digital converter coupled to the current source unit for converting a voltage applied to the organic light emitting diode to the respective one of the digital values;

a memory for storing the digital values; and a controller for controlling an amount of the second current sunk by the current digital-analog converter corresponding to the respective one of the digital values stored in the memory, wherein one frame is divided into a plurality of sub frames, and the sampling period is an initial period located at the beginning of the one frame, wherein each of the feedback lines is coupled to at least one pixel among the plurality of pixels, and wherein each of the pixels comprises:

a second transistor coupled to the feedback line, and turned on when the scan signal is supplied to a corresponding first scan line among the first scan lines;

a first transistor having a gate electrode coupled to a second electrode of the second transistor and for supplying an electric current to the organic light emitting diode;

a first capacitor between the gate electrode and a first electrode of the first transistor, and charged with a voltage corresponding to the second current;

a third transistor between a second electrode of the first transistor and the feedback line, and turned on when the scan signal is supplied to the corresponding first scan line among the first scan lines;

a fourth transistor between the first transistor and the organic light emitting diode;

a second capacitor between the fourth transistor and the first electrode of the first transistor, and charged with a voltage corresponding to the first data signal or the second data signal;

a fifth transistor between the fourth transistor and the data line, and turned on when the scan signal is supplied to a corresponding second scan line among the second scan lines; and a sixth transistor between an anode electrode of the organic light emitting diode and the feedback line, and turned on when the control signal is supplied to the control lines.

17. The organic light emitting display as claimed in claim 16, wherein the fifth transistor is turned on during the sensing period or the sampling period to receive the second data signal from the data line.

18. The organic light emitting display as claimed in claim 16, wherein the sixth transistor is turned on during the sensing period.

19. The organic light emitting display as claimed in claim 16, wherein the second transistor and the third transistor are turned on during the sampling period.

20. The organic light emitting display as claimed in claim 16, wherein the second capacitor is charged with a voltage corresponding to the first data signal or the second data signal when the second scan signal is sequentially supplied during at least one of the sub frames.

21. A method of driving an organic light emitting display, the method comprising:

supplying a first current via first current paths to organic light emitting diodes included in pixels during a sensing period;

supplying data signals from a data driver to the pixels;

converting voltages applied to the organic light emitting diodes corresponding to the first current to digital values and storing the digital values in a memory;

sinking a second current via second current paths, the second current being sunk in a sensing unit and received from the pixels using the digital values stored in the memory during a sampling period so that a degradation of the organic light emitting diodes is compensated; and charging the pixels with a voltage corresponding to the second current while sinking the second current in the sensing unit.

22. The method as claimed in claim 21, wherein the digital values of all the pixels are stored in the memory during the sensing period.

23. The method as claimed in claim 21, wherein the sensing period is located at a time when a power is supplied to the organic light emitting display.

24. The method as claimed in claim 21, wherein one frame is divided into a plurality of sub frames, and the sampling period is an initial period located at the beginning of the one frame.

25. The method as claimed in claim 24, further comprising:

supplying a first data signal of the data signals and a second data signal of the data signals to the pixels during a scan period of at least one of the sub frames, the first data signal causing light from the pixels to be emitted and the second data signal causing light from the pixels not to be emitted; and supplying the second current to the organic light emitting diodes of the pixels when the pixels receive the first data signal.

* * * * *